United States Patent [19]

Veyrassat et al.

[11] 4,451,008

[45] May 29, 1984

[54] DOUBLE WIRE-WINDING MACHINE WITH AUTOMATIC TRANSFER

[75] Inventors: Louis Veyrassat, Rolle; Marc Meisser, Meyrin, both of Switzerland

[73] Assignee: Maillefer S.A., Ecublens, Switzerland

[21] Appl. No.: 378,602

[22] Filed: May 17, 1982

[30] Foreign Application Priority Data

Jun. 3, 1981 [CH] Switzerland ..... 3637/81

[51] Int. Cl.[3] ..... B65H 54/02; B65H 67/04

[52] U.S. Cl. ..... 242/25 A

[58] Field of Search ..... 242/25 A, 25 R, 18 A, 242/18 PW

[56] References Cited

U.S. PATENT DOCUMENTS 4,369,928 1/1983 Riekkinen et al. ..... 242/25 A

*Primary Examiner*—Stanley N. Gilreath

*Attorney, Agent, or Firm*—Parkhurst & Oliff

[57] ABSTRACT

A disk bearing a clamp for snagging the wire is supported by a bearing and attached by rods to a wire guard, the axial movements of which are controlled by a jack. The disk and guard are rotatingly driven via a pulley and a belt. Two driving mechanisms made up of couplings, driven pulleys, and driving pulleys make it possible to drive the guard and the disk via an auxiliary shaft either at a speed synchronized with that of the reel or at a slightly slower speed. The clamp then lags behind the reel and forms a loop with the leading end of the winding.

6 Claims, 1 Drawing Figure

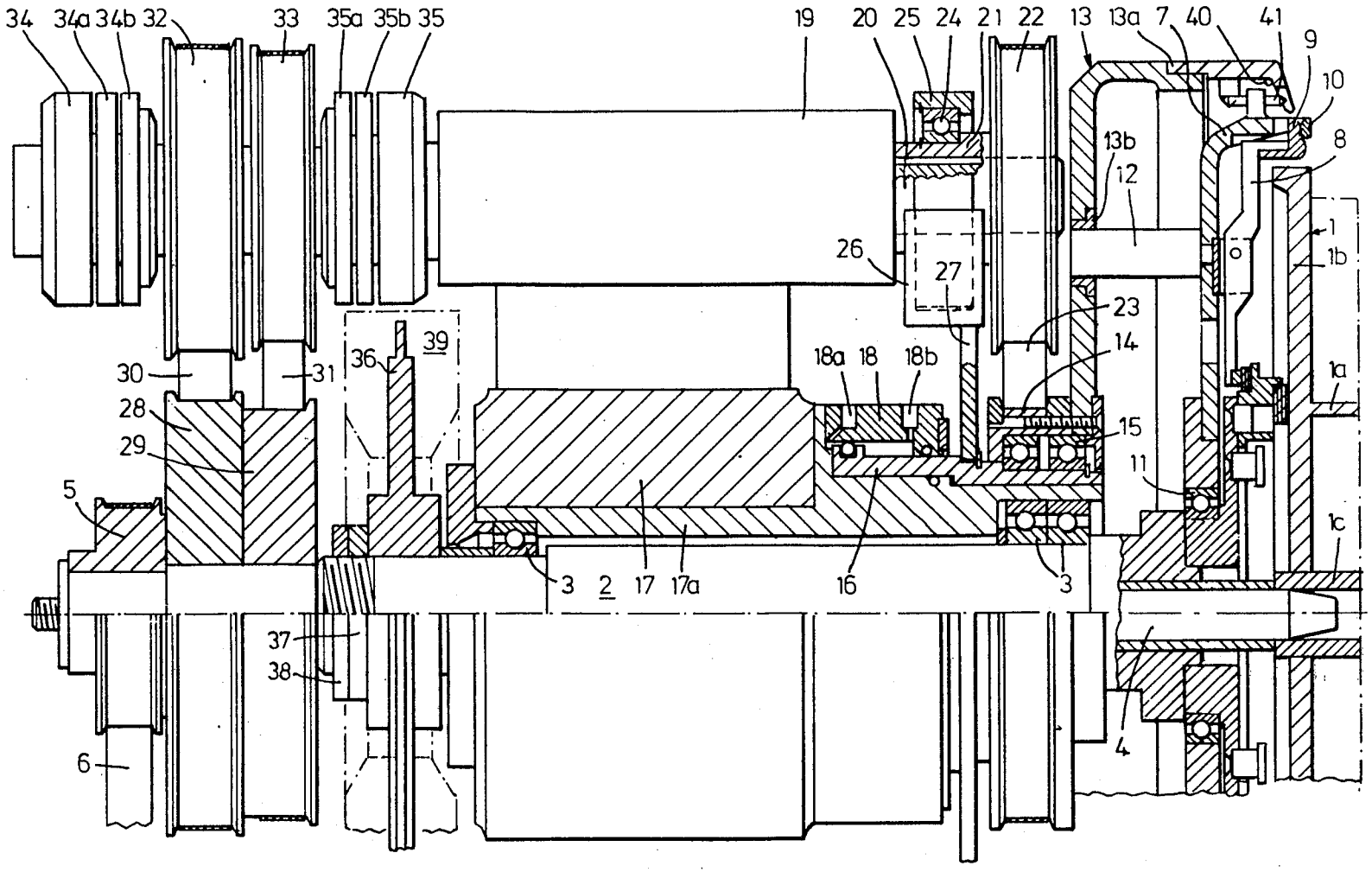
1
1b
1a
1c
8
10
9
41
40
7
13a
13
13b
12
23
14
15
11
4
3
22
21
24
25
20
27
26
18b
18
18a
16
19
17a
17
2
3
39
36
35
35b
35a
33
31
37
38
32
34b
34a
34
30
28
29
5
6

DOUBLE WIRE-WINDING MACHINE WITH AUTOMATIC TRANSFER

BACKGROUND OF THE INVENTION

This invention relates to winding machines, and more particularly to a double wire-winding machine having an automatic transfer device, of the type in which two snagging disks, each mounted coaxially with the drive shaft of a reel, are so arranged as to be able to effect a lagging movement of limited angular amplitude while the winding is being laid down, in order to form a reserve of wire with the leading end of the winding.

Double winding machines of this type have already been proposed, e.g., in our pending application Ser. No. 250,917, which describes a winding machine wherein the reserve of wire formed with the leading end of the winding comes to be positioned on a circular element that supports it along an arc of about 180 degrees, for example. In order to form the loop of wire constituting this reserve, a relative displacement is caused to take place between the drive shaft of the reel, rotating together with the latter, and the snagging disk. According to the aforementioned application, as well as in other prior art devices intended to serve the same purpose, this lagging movement is brought about by braking a rotary element borne by bearings on the shaft driving the reel.

Practical experience with prior art devices has shown that it is difficult to control the formation of the reserve of wire when the lagging movement of the snagging disk is caused by a braking operation, whether carried out directly upon the disk or upon some other element.

SUMMARY OF THE INVENTION

It is an object of this invention to provide an improved winding machine which overcomes the aforementioned difficulties by including a positive drive system for the snagging disks whereby their speed of rotation, normally the same as the drive shaft of the reel, can be temporarily modified.

To this end, the improved double winding machine according to the present invention, of the type initially mentioned, comprises transmission devices having a variable transmission ratio between each shaft and the corresponding snagging disk, as well as control means making it possible to vary temporarily the transmission ratio of the transmission device associated with the shaft of the reel being wound.

BRIEF DESCRIPTION OF THE DRAWING

A preferred embodiment of the invention will now be described in detail with reference to the accompanying drawing, which is an elevation, partially in section, showing the essential elements of the wire-winding machine according to the invention.

DETAILED DESCRIPTION OF A PREFERRED EMBODIMENT

Illustrated in the drawing are the means for driving a reel 1. However, the winding machine also comprises similar drive means disposed parallel to those shown for driving a second reel on which wire coming from a production line will be laid down while the equipment shown in the drawing is stopped for the purpose of replacing a full reel by an empty one.

Reel 1, having a barrel 1*a*, a flange 1*b*, and a hub 1*c*, is supported and driven by a drive shaft 2 resting on bearings 3. Shaft 2 is provided at the end thereof nearest reel 1 with a journal 4 movable axially so that it can be inserted in hub 1*c*. Journal 4 is of conventional design and need not be described in detail. At the other end, shaft 2 bears a pulley 5 making it possible to drive shaft 2 and reel 1 at the desired speed of rotation via a belt 6 coöperating with an electric drive motor (not shown). Prior to each transfer operation involving shaft 2, this motor is started up and gradually accelerates shaft 2 up to an adjustable maximum speed corresponding to that of the shaft driving the parallel reel, so that the peripheral speed of the outer surface of barrel 1*a* is equal to the linear speed of the wire being laid on the other reel.

The automatic transfer mechanism of the double wire-winding machine comprises a snagging disk 7 on which is pivoted a lever 8 bearing a jaw element 9 designed to coöperate with a jaw element 10, integral with disk 7, in order to constitute a wire-snagging clamp. Disk 7 is mounted on a bearing 11 and attached means of axial rods 12, distributed about its axis, to a wire guard 13 which is likewise coaxial with shaft 2. The outer part of guard 13 forms a rim 13*a* encircling disk 7. Wire guard 13 is integral with a pulley 14, and the assembly thus constituted is mounted on a tubular piston 16 via two bearings 15. Piston 16 is in turn borne by the base 17 of the machine which includes a tubular extension 17*a* containing the bearings 3 and having its outer surface machined so as to guide piston 16. Base 17 also bears a cylindrical part 18 which surrounds the left-hand end of piston 16, as viewed in the drawing, and forms the wall of a jack cylinder that can be supplied with compressed air through one or the other of two ports 18*a* and 18*b*. It will be understood that if compressed air is introduced through port 18*a* while port 18*b* is connected to an exhaust, piston 16 will move from left to right, as viewed in the drawing, carrying along bearings 15 and hence wire guard 13, as well as pulley 14. Eyelets 13*b* of guard 13 then slide on rods 12. The opposite movement takes place when it is port 18*b* that is connected to the source of compressed air.

It will now be explained how snagging disk 7 and wire guard 13 are rotatingly driven. Base 17 supports an elongated bearing housing 19 equipped at each end with antifriction bearings (not shown) in which an auxiliary shaft 20 freely rotates parallel to shaft 2. At its right-hand end, as viewed in the drawing, shaft 20 has a notched portion on which a sliding coupling 21 is fitted. Via a belt 23, a pulley 22 mounted on coupling 21 drives pulley 14 and hence wire guard 13 which, as previously stated, is integral with pulley 14. Sliding coupling 21 is mounted at the right-hand end of shaft 20 and bears, immediately next to pulley 22, a ball bearing 24, the outer race of which is integral with a ring 25 fixed in a fork-shaped gear case 26. A rigid upright 27 connects gear case 26 to tubular piston 16 so that when the jack (16, 18) is actuated in the manner previously described, sliding coupling 21 is displaced via ring 25 and bearing 24. Pulley 22 therefore moves axially with wire guard 13.

At the left-hand end of bearing housing 18, as viewed in the drawing, shaft 20 extends toward the rear and bears two drive mechanisms, both of which connect it to drive shaft 2. Each of these drive mechanisms comprises a driving pulley 28 or 29 which is keyed on shaft 2, a belt 30 or 31, a driven pulley 32 or 33 mounted loose on shaft 20, and a releasable electromagnetic coupling 34 or 35. Pulleys 32 and 33 rest on ball bearings mounted on shaft 20. Electromagnetic couplings 34 and 35 each comprise, in a manner known per se, a driven or inner part consisting of a tubular extension coaxial with shaft 20 and integral with the pulley 32 or 33 with which the coupling is associated. This tubular extension coöperates with ferromagentic elements which surround it and can be excited by means of coils housed in the outer part of the coupling. The outer parts of couplings 34 and 35 are keyed directly on shaft 20; they are provided with contact rings 34*a*, 34*b* or 35*a*, 35*b* connected (by means not shown) to an exciter circuit for applying a voltage to the electromagnets.

The arrangement further comprises a brake disk 36 mounted on shaft 2 and held in place by a nut 37 and a check nut 38. Brake disk 36 coöperates with brake shoes 39, indicated by dot-dash lines in the drawing, thus making it possible to block the winding machine rapidly in case of need.

In the transmission device associated with shaft 2 of the winding machine, the diameters of the various pulleys of the three drive mechanisms described are selected in such a way that the following operating conditions are achieved:

When one of the couplings, e.g., coupling 34, is excited while the other coupling, e.g., coupling 35, is deenergized, shaft 20 is driven by belt 30 and pulleys 28 and 32 at a speed such that parts 14, 13, and 7 rotate together at exactly the same speed as shaft 2. Thus, the rotation of clamp 9, 10 and of reel 1 is perfectly synchronized. If, on the other hand, electromagnetic coupling 34 is released while coupling 35 is closed, pulley 29 drives pulley 33 via belt 31 so that shaft 20 rotates at a slightly lower speed than in the other case. Parts 14, 13, and 7 are therefore slightly slowed down so that the clamp (9, 10) holding the end of the wire does not rotate quite so fast as reel 1.

It will readily be seen that with this transmission device, the formation of the loop intended to constitute the reserve of wire can be positively and precisely controlled. All that is necessary is to release coupling 35 and activate coupling 34 in order to cause snagging disk 7 and the clamp (9, 10) to rotate synchronously with reel 1 once more.

In the winding machine described above, the slowing down of snagging disk 7 is accompanied by a displacement of wire guard 13, so that the wire, designated as 40, is pushed inside the rim 13*a* of wire guard 13 by centrifugal force.

When guard 13 subsequently returns to the position shown in the drawing, the loop formed by the length of wire 40 is pulled over fingers 41 borne by disk 7 and then rests upon fingers 41 as the turns of wire gradually pile up on reel 1.

However, the variable-ratio transmission device described above may also be used in a double wire-winding machine in which the means provided for forming the reserve of wire operate differently from those shown in the drawing. Thus, the snagging disk might not include fingers 41; and instead of wire guard 13, an uncoiling member might be provided between the snagging disk and the reel. When the snagging disk slowed down to form the loop of wire, the uncoiling member would effect a greater lagging movement than the snagging disk so as to lay the loop on a cylindrical surface coaxial with the reel and would hold it there firmly during the entire winding operation. A detailed description of such an arrangement will be found in our pending application Ser. No. 250,917, mentioned earlier.

The advantage of the present transmission device is, as already stated, that modifications in the speed of rotation of the snagging disk can be positively and accurately controlled thereby, and the formation of the reserve of wire can consequently be regulated as desired.

As may be seen from the accompanying drawing, this variable-ratio transmission device can be so designed as to be incorporated in a winding machine without increasing the overall size of the machine to an extent which would adversely affect its operation.

What is claimed is:

1. A machine for use in double-winding having an automatic transfer device and including at least one reel driving shaft, means for driving a reel coupled to a forward end of said driving shaft, a bearing device for supporting said shaft near said forward end, a wire snagging disk disposed coaxially with said driving shaft and means for driving said disk with said driving shaft and for causing said disk to effect a lagging movement with respect to said driving shaft during a predetermined period of time during a winding operation, said means for driving said disk comprising an auxilliary shaft parallel to said driving shaft, first transmission means between said driving shaft and said auxilliary shaft, and second transmission means between said auxilliary shaft and said snagging disk, wherein the improvement in said means for driving said disk comprises:

said means for driving said disk exclusively comprising said first and second transmission means wherein said first transmission means includes two separate transmission gears with slightly different transmission ratios, each of said transmission gears being coupled between said driving shaft and said auxilliary shaft and each having a gear part secured to said driving shaft, said first transmission means further including two disengageable coupling devices each coupled between said auxilliary shaft and a different one of said transmission gears to selectively couple one of said transmission gears to drive said auxilliary shaft, said gear parts of both said transmission gears which are secured to said driving shaft being located behind said bearing device with respect to said forward end.

2. The winding machine of claim 1 wherein said second transmission means comprises a pair of gear parts one of which is coaxial with said driving shaft and the other of which is coaxial with said auxilliary shaft and means for connecting said gear parts together, said bearing device having a forward portion and said gear part coaxial with said driving shaft being arranged to surround said forward portion and being constructed integral with said snagging disk for rotation therewith.

3. The winding machine of claim 1 further comprising a wire guard coaxial with said driving shaft and coupled for rotation with said snagging disk and axially movable with respect to said driving shaft and said snagging disk between a rear and a forward position, and further wherein said second transmission means comprises a pair of gear parts one of which is coaxial with said auxilliary shaft and the other of which is coaxial with said driving shaft and means for connecting said gear parts of said second transmission means to one another, said one gear part of said second transmission means coaxial with said driving shaft being rigidly secured to said wire guard and supported by a bearing on a tubular support axially movable on said bearing device, and further comprising coupling means between said wire guard and said snagging disk for integrally connecting said wire guard and snagging disk for rotation with one another while permitting said axial displacement of said wire guard with respect to said snagging disk.

4. In a winding machine including at least one reel driving shaft, means coupled to said driving shaft for driving a reel, a wire snagging disk disposed coaxially with said driving shaft and means for driving said disk with said driving shaft and for causing said disk to effect a lagging movement with respect to said driving shaft during a predetermined period of time during a winding operation, the improvement in said machine comprising:

a wire guard coupled coaxially to said driving shaft for rotation with said snagging disk and axially movable with respect to said driving shaft and said snagging disk; and means for axially displacing said wire guard along said driving shaft.

5. The machine of claim 4 wherein said means for driving said disk comprises an auxilliary shaft parallel to said driving shaft, first transmission means coupled between said driving shaft and said auxilliary shaft for driving said auxilliary shaft and second transmission means coupled between said auxilliary shaft and said snagging disk for driving said snagging disk, said first transmission means including first and second transmission gears with slightly different transmission ratios coupled to selectively drive said auxilliary shaft at a speed determined by one of said ratios and further wherein said second transmission means is coupled to said means for axially moving said guard such that said second transmission means is axially displaced along said driving shaft.

6. In a winding machine including at least one reel driving shaft, means for driving a reel at a forward end of said shaft, a wire snagging disk disposed coaxially with respect to said driving shaft, and means for driving said disk with said driving shaft and for causing said disk to effect a lagging movement with respect to said driving shaft during a predetermined period of time during a winding operation, the improvement in said means for driving said disk comprising:

a auxilliary shaft parallel to said driving shaft;

first transmission means coupled between said driving shaft and said auxilliary shaft for driving said auxilliary shaft at a selected one of at least two driving speeds; and second transmission means coupled between said auxilliary shaft and said snagging disk for driving said snagging disk at a speed determined by the speed selected by said first transmission means, said at least two different speeds being such that at one speed said snagging disk is driven at the same speed as said driving shaft and at the other speed said snagging disk is driven at a speed which lags with respect to the speed of said driving shaft.

* * * * *